US010569157B2

(12) United States Patent
Mruk

(10) Patent No.: US 10,569,157 B2
(45) Date of Patent: Feb. 25, 2020

(54) METHOD AND SYSTEM FOR PLAYING A BOWLING GAME IN COMBINATION WITH A GAME OF FOOTBALL AS A SECONDARY GAME

(71) Applicant: James Charles Mruk, Hillsboro, OR (US)

(72) Inventor: James Charles Mruk, Hillsboro, OR (US)

(73) Assignee: JAM-N ENTERPRISES, INC., Longwood, FL (US)

( * ) Notice: Subject to any disclaimer, the term of this patent is extended or adjusted under 35 U.S.C. 154(b) by 0 days.

(21) Appl. No.: 14/998,319

(22) Filed: Dec. 24, 2015

(65) Prior Publication Data

US 2016/0214000 A1 Jul. 28, 2016

Related U.S. Application Data

(60) Provisional application No. 62/096,759, filed on Dec. 24, 2014.

(51) Int. Cl.

| | |
|---|---|
| ***A63D 1/00*** | (2006.01) |
| ***A63D 5/04*** | (2006.01) |
| ***A63D 3/00*** | (2006.01) |

(52) U.S. Cl.

CPC ..... *A63D 5/04* (2013.01); *A63D 3/00* (2013.01); *A63D 2005/048* (2013.01)

(58) Field of Classification Search

CPC ..... A63D 5/04; A63D 3/00; A63D 2005/0048
USPC ..... 473/54, 70, 71; 463/2, 4, 36
See application file for complete search history.

(56) References Cited

U.S. PATENT DOCUMENTS

| | | | | |
|---|---|---|---|---|
| 4,597,575 | A | 7/1986 | Kosof | |
| 4,787,633 | A | 11/1988 | Fritzemeier | |
| 4,817,947 | A | 4/1989 | Gautraud | |
| 4,878,664 | A * | 11/1989 | Brookes | A63D 15/20 473/23 |
| 4,948,128 | A * | 8/1990 | Emery, II | A63D 15/20 473/17 |
| 5,026,053 | A * | 6/1991 | Paterson | A63D 15/00 473/1 |
| 5,899,815 | A | 5/1999 | Helou et al. | |
| 6,270,411 | B1 | 8/2001 | Gura et al. | |
| 6,464,595 | B2 | 10/2002 | Tsujita | |
| 7,614,944 | B1 * | 11/2009 | Hughes | A63F 13/12 463/4 |
| 8,070,575 | B2 | 12/2011 | Mruk | |
| 8,087,987 | B2 | 1/2012 | Mruk | |

(Continued)

OTHER PUBLICATIONS

STIC Search.

*Primary Examiner* — Joseph B Baldori
(74) *Attorney, Agent, or Firm* — Michael Artemis

(57) ABSTRACT

A method and system for playing a bowling game in combination with a football-type game is disclosed. The method and system comprising the steps of initiating a conventional bowling game, filling at least one bowling frame, evaluating a bowling score for at least one bowler, generating a football play result based on the bowling score, displaying a football position based on the football play result, continuing the bowling game and generating the football play result until a 10th frame of bowling is completed, determining a winning football team, and providing an award to the winning football team.

19 Claims, 4 Drawing Sheets

(56) References Cited

U.S. PATENT DOCUMENTS 8,292,733 B2 * 10/2012 Crawford ..... A63D 5/04 273/309
8,317,586 B2 * 11/2012 Ansari ..... G07F 17/32 273/138.1
RE44,095 E * 3/2013 Sanchez ..... 463/40
8,944,921 B2 * 2/2015 Knapp ..... A63B 71/06 463/42
9,457,261 B2 * 10/2016 Vaioli ..... A63F 13/005
9,472,053 B2 * 10/2016 Kaiblinger ..... G07F 17/3262
9,504,904 B2 * 11/2016 Vaioli ..... A63F 13/005
2001/0024970 A1 * 9/2001 McKee ..... G07F 17/32 463/16
2003/0087707 A1 5/2003 Lavoie et al.
2006/0073870 A1 * 4/2006 Cannon ..... G07F 17/32 463/17
2007/0102877 A1 * 5/2007 Personius ..... G07F 17/32 273/138.2
2008/0171607 A1 7/2008 Minard et al.
2008/0182644 A1 * 7/2008 Lutnick ..... G07F 17/3258 463/20
2010/0009768 A1 * 1/2010 Munson, Jr. ..... A63D 15/00 473/1
2010/0134687 A1 6/2010 Vaioli
2010/0227658 A1 9/2010 Crowder et al.
2010/0279774 A1 * 11/2010 Braig ..... A63F 13/798 463/40
2011/0034225 A1 * 2/2011 Butz, Jr. ..... A63F 13/12 463/4
2014/0135101 A1 * 5/2014 Abrahamson ..... G07F 17/3286 463/22
2015/0148129 A1 * 5/2015 Austerlade ..... H04L 43/04 463/31
2016/0133088 A1 * 5/2016 Givant ..... G07F 17/3237 463/25
2016/0199736 A1 * 7/2016 Knapp ..... A63F 13/65 463/65

* cited by examiner

METHOD AND SYSTEM FOR PLAYING A BOWLING GAME IN COMBINATION WITH A GAME OF FOOTBALL AS A SECONDARY GAME

RELATED APPLICATIONS

This Non-Provisional Utility Patent Application claims priority to U.S. Provisional Patent Application 62/096,759 filed on Dec. 24, 2014 which is incorporated herein in its entirety.

BACKGROUND OF THE INVENTION

Field of the Invention

The present invention relates to the sport of bowling and in particular to a method and system for playing a bowling game.

Related Art

Bowling is a popular sport that has been around for centuries. It is one of the oldest most widely played games in the world. The sport of bowling is played recreationally, in organized leagues and in various competitions by millions of people, of every age, any gender. Since the inception of bowling, which can be traced back to the Stone Age, the game has evolved from a very basic/rudimentary form of the sport, to the high-tech game of bowling that is known and played today. Over the years, there have been many variations and improvements to the game to continually challenge a player, maintain player interest and increase public interest regarding the sport.

In one known variation, a player participating in a bowling game is presented with an alternate game play method which modifies the traditional number of balls that may be delivered in a particular frame. This known variation, while somewhat useful, has drawbacks. In both the conventional and this variation of bowling, the determination of the winning score is cumbersome and difficult for many players to understand and perform. Another drawback is that merely altering the number of balls that may be delivered during a particular frame reduces the excitement and challenge of having to perform well during that frame.

Another known variation of bowling, attempts to provide a bowling game that is more exciting and easier to understand. In this variation, the traditional game of bowling is combined with the player betting with an allotted number of betting points during each frame. This known variation, while somewhat useful, has substantial drawbacks. One drawback pertains to the added layer of complexity in determining and tracking multiple payer bets for each frame. Another drawback with this variation is that a player may engage in a betting strategy that produces less than desired results, thereby decreasing the excitement and desire of the player to continue playing.

In other known variations of bowling, various attempts have been made to alter or handicap the score of a new or challenged player. These known variations, while somewhat useful, have significant drawbacks. Firstly, as stated above, the determination of a winning score in a traditional game of bowling is rather difficult and time consuming to perform. Secondly, the determination of the score is highly dependent upon the specific sequence in which the players obtain strikes and spares and the application of various handicapping methods may provide inconsistencies in scoring. Finally, the adaptation of one or more of these various handicapping methods may greatly increase the complexity of the game and further limit the understanding for a new player.

In one known improvement, a significant technological advancement in the ease of scoring a game of bowling was provided. This improvement generally comprised the introduction of the automatic pinspotter and computerized scoring system. This known improvement, while somewhat useful, has substantial drawbacks. One primary drawback is the increased expense in installing and maintaining this equipment. For large commercial bowling centers, the cost associated with providing these advanced systems may be deferred across many bowling lanes, however, for smaller bowling centers these costs usually take a very long time to defer. So much so, that some smaller bowling centers may chose to forgo the installation of such systems. Another drawback is the ease of use for the player. Some systems are complex and require some form of user training which takes time away from the bowling activity.

Efforts to provide a method and system for playing a bowling game that overcomes the drawbacks in the prior art have not met with significant success to date. As a result, there is a need in the art for a method and system for playing a bowling game capable of increasing player excitement and facilitating the scoring process. The method and system described herein overcomes these drawbacks and provides additional new and useful benefits.

SUMMARY OF THE INVENTION

To overcome the drawbacks of the existing systems and provide additional benefits, a method and system is disclosed which increases player excitement and facilitates the scoring process.

From the broadest method aspect, the invention comprises a method of playing a bowling game in which players are permitted to participate in a secondary football-type game, the method comprising the steps of: (a) initiating a bowling game, wherein at least one player participates in a football-type game in combination with the bowling game; (b) filling at least one bowling frame; (c) evaluating a bowling score for at least one bowler; (d) generating a football play result based on the bowling score; (e) displaying a football position based on the football play result; (f) continuing the bowling game and generating the football play result until a 10th frame of bowling is completed; (g) determining a winning football team; and (h) providing an award to the winning football team.

Other systems, methods, features, step combinations and advantages of the invention will be or will become apparent to one having ordinary skill in the art upon examination of the following figures and detailed description. It is intended that all such additional systems, methods, features, step combinations and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts/elements/steps throughout the different views.

DETAILED DESCRIPTION OF THE PREFERRED EMBODIMENTS

Figure 1:
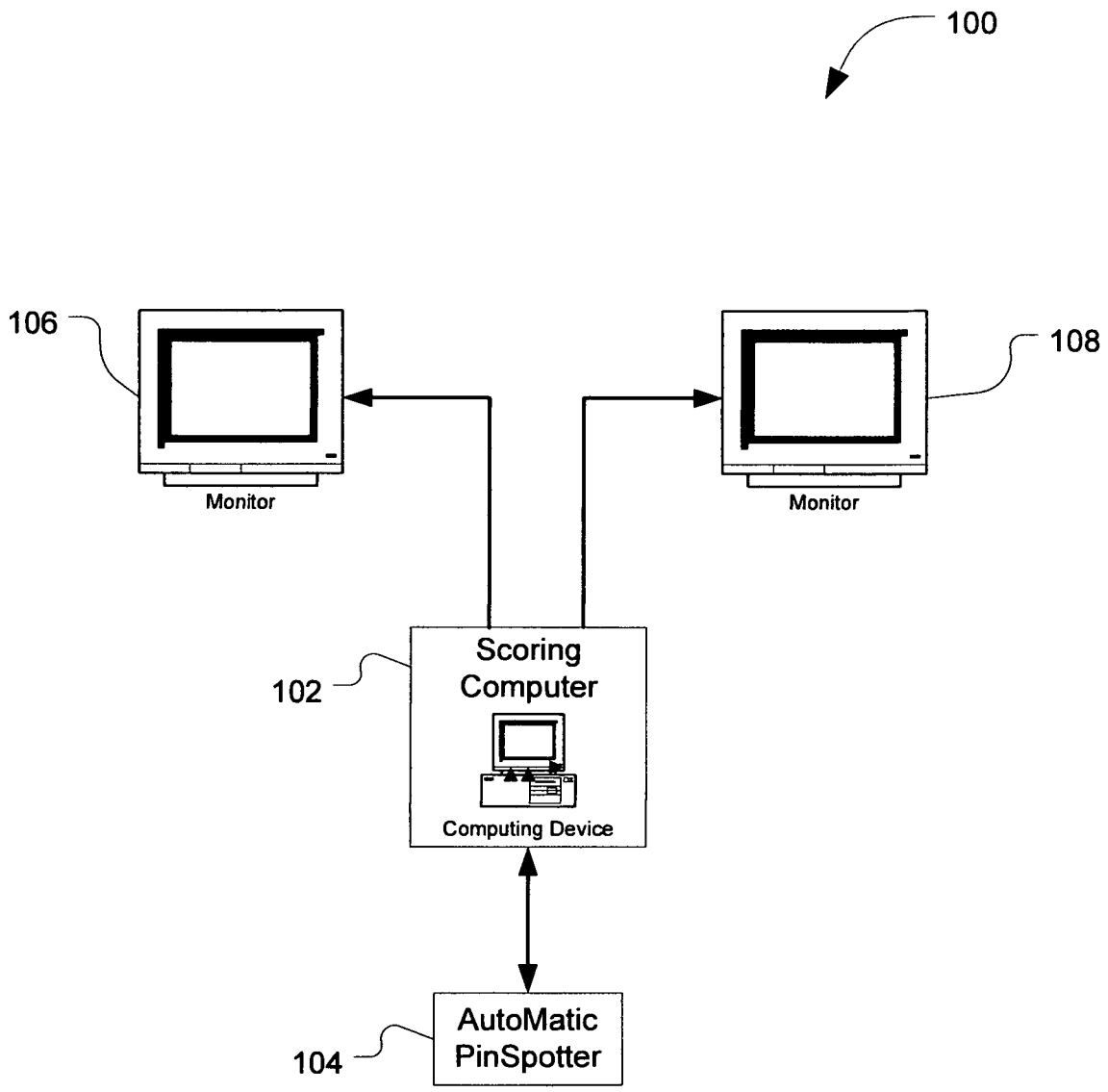
FIG. 1 is a schematic illustrating elements of a bowling scoring system utilized in an exemplary embodiment in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In the following description, numerous specific details are set forth in order to provide a more thorough description of the present invention. It will be apparent, however, to one of ordinary skill in the art, that the present invention may be practiced without these specific details. In other implementations, well-known features and methods have not been described in detail so as not to obscure the invention. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The method and system for playing a bowling game in combination with a secondary football-type game is contemplated to generally follow some basic game rules. Specific embodiments, examples and implementations will be discussed in further detail below. To begin, the general game rules of the present invention combine standard ten pin bowling and the traditional game rules of football where bowling scores are kept as normal. A secondary digital/virtual football game occurs as a result from player bowling scores on a frame by frame basis. The football game is displayed on at least one overhead scoring display and concurrent with the regular bowling scores. In one embodiment, there are 10 bowling frames and the simulated game of football is played until conclusion within those 10 bowling frames; there is no time clock, there are no quarters and no kick offs that are generally associated with a standard game of football.

It is contemplated that there is a maximum of ten players on a pair of lanes and a maximum of five players on a single lane. However, other numbers of players may be permitted and implemented by practicing the present invention. When using a pair of lanes, an equal amount of players are required on each team/lane. In the event of an absent team player, standard absentee player scoring will be used and the scoring computer (discussed in further detail below) will generate random absentee player scores on a frame by frame basis. The random computer generated absentee frame by frame bowling score will be used to generate football game results for that absent player.

In one exemplary embodiment, players on the left lane are designated the home team and players on the right lane are the visiting team. The home team begins on offense and the visiting team begins on defense. The home team moves from left to right and the visiting team moves from right to left. The home team gets possession of the football on their 20 yard line and is on offense to begin the game.

In an alternate embodiment, when only one bowling lane is used, the single lane players will compete against the computer. The single lane players are the home team and the computer represents the visitors.

It is contemplated that the scoring computer creates names, simulates frames and generates bowling scores. Bowlers names entered into the scoring system will appear on the displayed football field in a designated region of the display. The bowlers on the left lane or odd numbered lane will appear on the home team roster. The bowlers on the right lane or even numbered lane will be on the visitor roster. All names will appear as soon as the first ball is thrown on either lane.

In one exemplary embodiment, the offense has 3 plays or downs to gain 10 yards which results in a first down. If it becomes 4th down, the play will result in a punt, field goal, or an attempt to gain the first down. If it is 4th down and the offense is on or outside the opponent's 35 yard line, the play will result in a punt of 36, 37, 38, 39 . . . 50 yards, which is randomly selected by the computer. If the punt should travel into the end zone of the opponent or cross their goal line, it is a touchback and the receiving team will gain possession on their own 20 yard line.

However, if it is 4th down and the offense is on or inside the 30 yard line, of the opponent, the result of the play will be an automatic field goal. In an alternate embodiment, the result may be randomly determined by the scoring computer.

In the case of a 4th down for the offense and ball on the 31, 32, 33, or 34 yard line of the opponent, an attempt at a 1st down will occur. The result of this attempt is contemplated to be randomly determined by the scoring computer. Should the attempt at a first down fail, at this point, a change of possession will occur, where offense goes to defense and defense goes to offense and will take over possession at the current field location/spot of the football. Change of possession occurs after a touchdown, field goal, safety, punt, fumble or a failed attempt at a 1st down. A touchdown (crossing the goal line of the opponent) will result in 7 points. A field goal (the ball is kicked thru the goal post of the opponent) results in 3 points. A safety (stopping the opponent inside their own goal) results in 2 points for the defense. Scores are tallied and posted on the field scoreboard. After bowling 10 frames is completed, the team with the most football points displayed on the football scoreboard is the determined the winner.

It is contemplated, that in the event of a tie, the team with the most points accumulated in the $10^{th}$ frame will be awarded a field goal, thus breaking the tie. For example, the $1^{st}$ home team bowler scored a 9/X=20 pins in the $10^{th}$ frame, the $2^{nd}$ home team bowler scored a 9 0=9 pins and the $3^{rd}$ home team bowler scored X X X=30 PINS. The home team would have a total=59 pins for the $10^{th}$ frame if this total for the $10^{th}$ frame exceeds the $10^{th}$ frame total for the opponents (visiting team), the home team will be awarded a field goal, thus breaking the tie.

In accordance with the present invention, the results of the bowlers on a frame by frame basis will determine the movement of the football and will displayed on at least one display and graphically illustrated on the football field. The movement the football on the display will either be in a positive direction (gain) or a negative direction (loss). The movement of the football in a positive or negative direction is determined by the bowling score results of each player on a frame by frame basis. For example, home team bowler 1 in frame 1, versus the visiting team bowler 1 frame 1. If the home team was on offense, a positive direction would be left to right on the displayed top view of the football field. This would also be referred to as a positive direction (gain) for the home team. Conversely, if the home team was on offense, a negative direction (loss) would be right to left.

The following table illustrates, in one exemplary embodiment, the type of frame by frame results that will result in a positive (gain), a negative (loss) or no movement for the football. However it is contemplated that other combinations and movement distances may be randomly selected by the scoring computer. Additionally, the $10^{th}$ frame (may provide up to 3 thrown balls for each bowler) is treated according to the following table where the first two balls thrown in the frame count towards the result. In an alternate embodiment the last two balls thrown in the $10^{th}$ frame may be used to obtain results according to the following table.

| Offense | Defense | Result |
|---|---|---|
| Strikes (X) | Strikes (X) | No gain/loss either team |
| Strikes (X) | Spares (/) | Gain of 1, 2, 3 . . . 10, 15 or 20 yards for the offense randomly selected by the scoring computer. |
| Strikes (X) | Opens (no strike or spare) | Gain of 21, 22, 23 . . . 30, 35, 40 or 45 yards for the offense randomly selected by the scoring computer. |
| Spares (/) | Strikes (X) | A loss of 1, 2, 3 . . . 7 yards for the offense randomly selected by the computer. |
| Spares (/) | Spares (/) | The difference of pins on the first ball in the frame determines the result. For example, offense 9/ and the defense 7/ = a gain of 2 yards for the offense. Conversely offense 7/ and defense 9/ = a loss of 2 yards for the offense. |
| Spares (/) | Opens (no strike or spare) | A gain of 1, 2, 3 . . . 10, 15 or 20 yards for the offense randomly selected by the scoring computer. |
| Opens (no strike or spare) | Strikes (X) | Fumble recovery by the defense at the spot of play. |
| Opens (no strike or spare) | Spares (/) | A loss of 1, 2, 3 . . . 7 yards for the offense randomly selected by the computer. |
| Opens (no strike or spare) | Opens (no strike or spare) | The difference in pins on first ball thrown in the frame. For example, the offense scores 9--0 in the frame and the defense scores 6--3 in the frame = a 3 yard gain for the offense. Conversely, the defense scores 9--0 in the frame and the offense scores 6--3 in the frame = a loss of 3 yards for the offense. |

In further accordance to the present invention, performance points may be accumulated and tracked for each player. These performance points will be displayed at the completion of the football game for each player. It is contemplated that the performance points can be used to establish rankings for a fantasy football aspect of the present invention. In one exemplary embodiment, a bowler can elect to compete in a fantasy football aspect of the present invention where this supplemental contest utilizes the performance points they acquire during their league play. For example, if a player on offense strikes and his/her opponent on defense opens and the play results in a touchdown, the player on offense will be credited with performance points. In one exemplary embodiment, performance points may be awarded according to the following tables:

| Offensive Performance Points | |
|---|---|
| Touchdown | 5 points |
| Gain of 20 yards or more | 3 points |
| Gain of 5-10 yards | 1 point |

| Defensive Performance Points | |
|---|---|
| Fumble recovery | 5 points |
| Safety | 3 points |
| Loss for offense on the play | 1 point |

It is contemplated that the bowler desiring to participate in the fantasy football aspect will have previously registered or signed up on a dedicated website that manages the fantasy football aspect. The fantasy football aspect is envisioned to be a weekly contest or an entire season contest. The performance points are determined by the bowling scoring system during league play and standings will be posted on the website. The bowler will pay an entry fee to participate in the fantasy football aspect and prizes will be awarded according to the number of entries received. In one embodiment, the prize ratio will be 1 out of 8. For example, if there are 80 entries prizes will be allocated for 10 places. It is contemplated that the fantasy football aspect may be implemented within individual bowling centers or combined with many bowling centers to provide national fantasy football aspect participation.

Reference is now made to the figures where a bowling scoring system 100 is shown in FIG. 1. The scoring system 100 generally comprises at least one scoring computer 102. The scoring computer 102 commonly has at least one input device such as a keyboard, touchpad or other means for a player to input data into the scoring computer 102. Further, scoring computer 102, may include, one or more processors, a display device, data storage devices, memory and other associated hardware that are operatively coupled together and provide computing functionality. The scoring computer 102 also includes one or more algorithms or machine readable code that facilitates the storage, processing, and display of information in accordance with the present invention. The scoring computer 102 has memory configured with machine readable code stored thereon, wherein the processor is configured to read and execute the machine readable code. Scoring computer 102 is operatively coupled to at least one automatic pinspotter 104, a primary display 106 and at least one secondary display 108. The automatic pinspotter 104 provides scoring computer 102 with real-time data regarding the status of the bowling pins during a frame of bowling. The functionality of the pinspotter 104 is well-known and will not be described in detail so as not to obscure the invention. Primary display 106 is utilized to display player scoring sheets/cards for each bowling frame and each game. Primary display 106 may be a CRT monitor, an LCD screen, a plasma screen, a portable tablet or other type of image/information displaying device. Additionally, primary display 106 may be partitioned into a plurality of smaller display areas such that multiple types of player data or information may be displayed on that single display. Secondary display 108 is utilized to display information to players during each bowling frame and each game. Secondary display 108 may be a CRT monitor, an LCD screen, a plasma screen, a portable tablet or other type of image/information displaying device. Additionally, secondary display 108 may be partitioned into a plurality of smaller display areas. These partitioned display areas of the secondary display 108 may be configured to display other information, sporting events such as football, baseball, soccer, boxing, racing or combinations thereof. Both primary and secondary displays 106, 108 are typically assigned to a pair of bowling lanes and mounted in a location such that each player can readily view each display.

Figure 2:
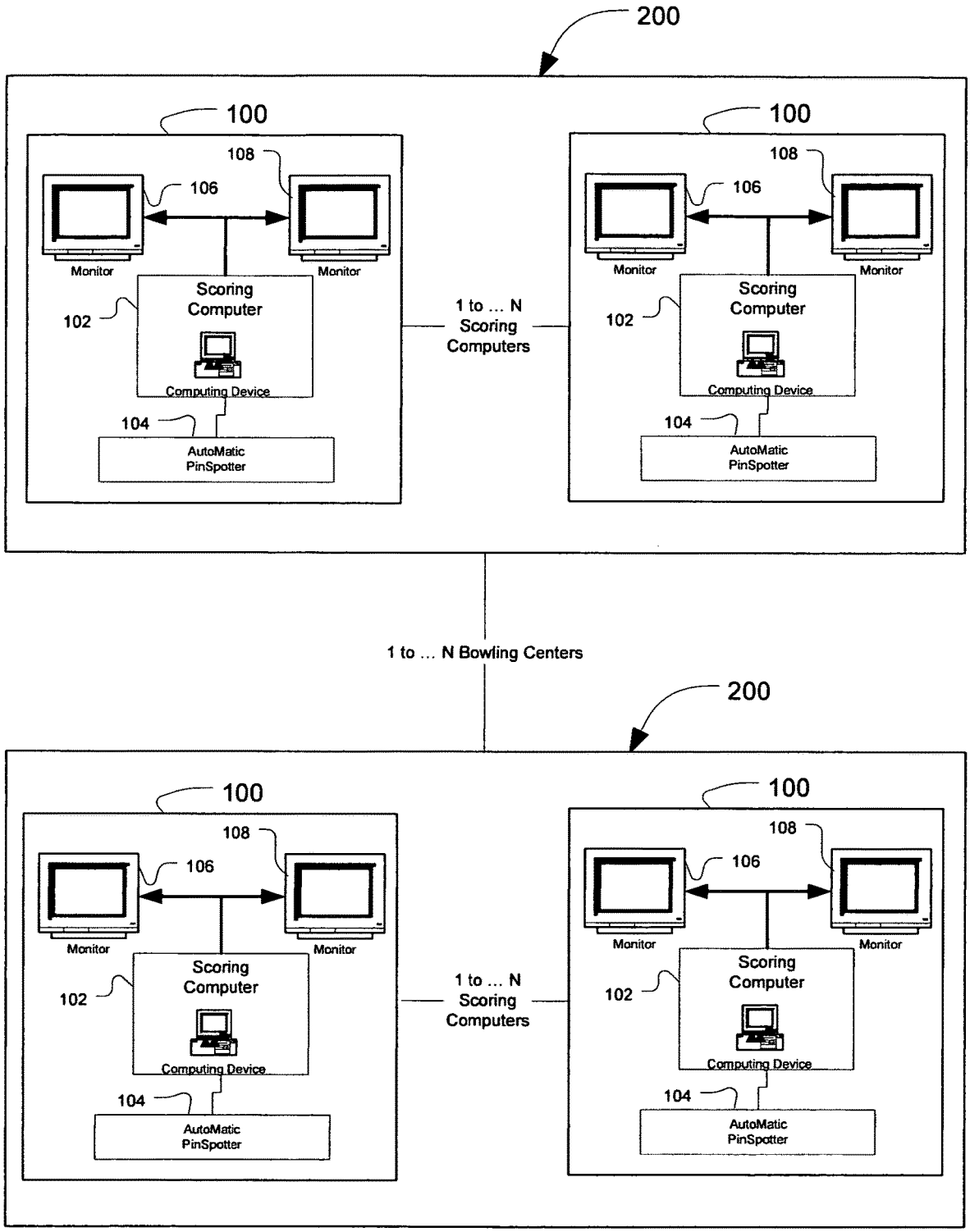
FIG. 2 is a schematic illustrating a plurality of bowling scoring systems as shown in FIG. 1, operatively coupled together to form typical bowling center and further illustrating a plurality of bowling centers operatively coupled together to form linked network of bowling centers as used in an exemplary embodiment in accordance with the present invention.

A bowling center scoring system 200 is shown in FIG. 2 which includes one or more bowling scoring systems 100 (previously described above with reference to FIG. 1) are operatively coupled together via wired and/or wireless networking means. The bowling center scoring system 200 generally provides automated scoring for each of bowling lanes in the bowling center. In one exemplary embodiment, bowling center scoring system 200 provides scoring for use during regular bowling tournament and/or bowling league events at the bowling center. It is further contemplated that multiple bowling centers may be operatively coupled together via the internet or other computer networking means such that the multiple bowling centers in various locations may concurrently implement the present invention. It is contemplated that the multiple concurrent implementations of several bowling centers can coincide with the regular football season as scheduled by the National Football League™ (NFL™). Alternatively, the bowling center may implement the present invention separate from any officially scheduled football game(s).

In accordance with the present invention, a conventional game of bowling is played and combined with a football-type game such as played in the National Football League™ (NFL™). It is contemplated that from one to ten or more players may participate per pair of bowling lanes. The conventional game of bowling consists of 10 frames of play, is well-known in the art, and will not be described in detail so as not to obscure the invention. In one exemplary embodiment, each player will be presented the opportunity, when initializing a game of bowling, to select/decide whether or not they would like to participate in the secondary football-type game aspect of the bowling match. It is further contemplated, that each player participating in the secondary football-type game may be required to pay an additional fee to the bowling center for the opportunity to enjoy this aspect of the bowling match. Correspondingly, only players that have selected/decided to participate in the football-type game aspect of the bowling match will receive and/or acquire football play results during bowling play.

Figure 3A:
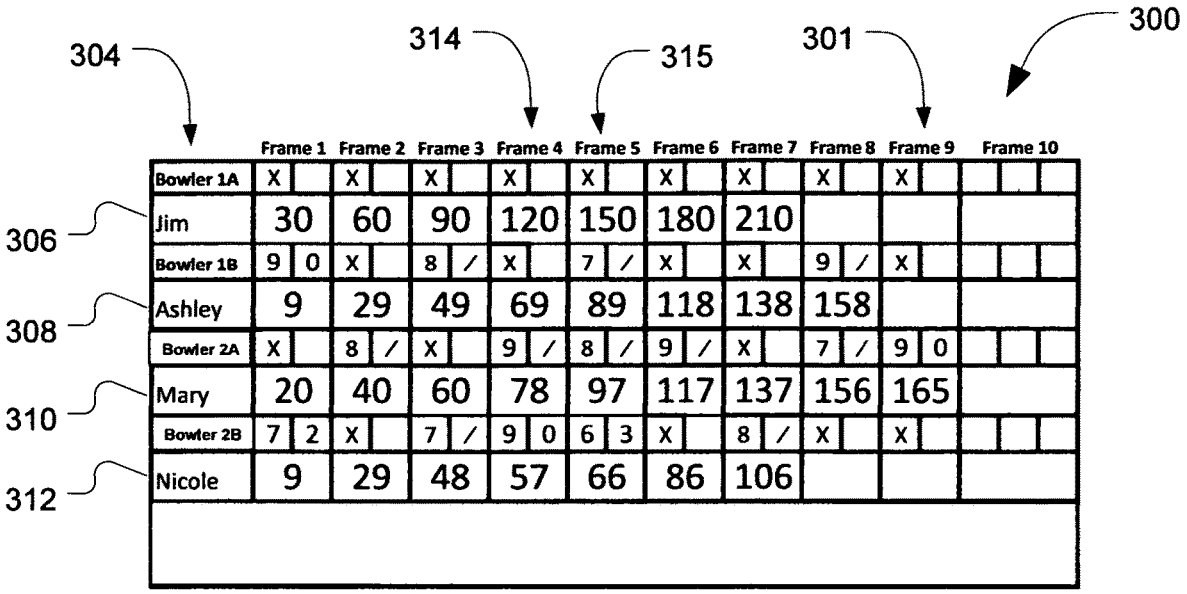
FIG. 3A illustrates a standard scoring sheet after a $9^{th}$ frame of bowling as used in an exemplary embodiment in accordance with the present invention.
Figure 3B:
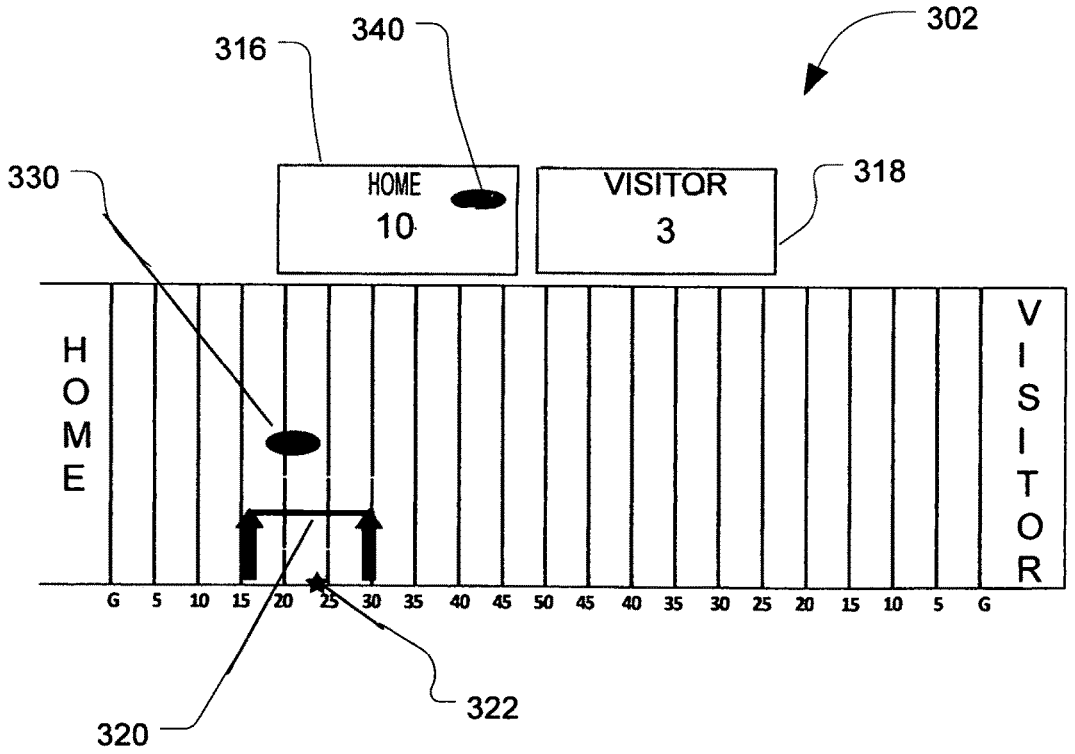
FIG. 3B is a top view of an exemplary football-type field in accordance with an exemplary embodiment of the present invention.

Attention is drawn to FIGS. 3A and 3B in which, FIG. 3A illustrates a standard bowling scoring sheet 300 after a $9^{th}$ frame of bowling 301 has been completed and FIG. 3B illustrates a top view of an exemplary top view of a typical football field layout 302 illustrating the home team on offense with possession on/or about the their 24 yard line as indicated by marker 322. In an exemplary embodiment, the scoring sheet 300 has a plurality of bowlers listed in column 304. Since the bowling scoring system 100 is configured to handle two bowling lanes, typically a Lane 1 and Lane 2 respectively, it is contemplated that the active bowlers and/or team players will be assigned to a particular lane and designated as home or visiting team as described above.

When more than one bowler is assigned to a lane, each bowler will be assigned a sequential letter for further identification. For example, and referring to column 304 of FIG. 3A, there may be two bowlers assigned to Lane 1 and two bowlers assigned to Lane 2. For Lane 1, the first bowler is bowler 1A-"Jim" 306 and the second bowler is bowler 1B-"Ashley" 308 where these two bowlers would comprise a first team of bowlers. For Lane 2, the first bowler is 2A-"Mary" 310 and the second bowler for Lane 2 is 2A-"Nicole" 312 thereby comprising a second team of bowlers.

Once assigned to a lane, each bowler that is participating in the bowling game of the present invention will then proceed to bowl according to standard bowling procedures. It should be noted that all the bowlers complete or fill their frames of bowling in the conventional well-known manner. Each bowling frame is considered "filled" when a bowler makes a strike, or attempts a second shot to pick up a spare. The play of the football aspect of the present invention is evaluated after one player from each team completes a frame of bowling. The football is advanced or retarded according to the rules as described in detail above.

In one exemplary embodiment, scoring sheet 300 may be an electronic form displayed on the primary display 106 of FIG. 1. In an alternate embodiment, scoring sheet 300 may be a traditional paper-type scoring sheet. Additionally, the football-type field 302 may be an electronic or digital image displayed on the secondary display 108 of FIG. 1. In an alternative embodiment, football-type field 302 may be displayed in a partitioned area of the primary display 106, where this partitioned area is separate from display of scoring sheet 300.

The conventional game of bowling now continues through all 10 frames and is evaluated on a frame by frame and player by player basis regarding the football game aspect of the present invention. For example, in frame 4 designated 314 the frame by frame and corresponding football movement would be as follows. Bowler 1A "Jim" 306 obtained a strike (X) for the offense and corresponding Bowler 2A "Mary" 310 obtained a spare (9/) for the defense. As a result of the bowling performance by Bowler 1A "Jim" 306 and Bowler 2A "Mary" 310 in filled frame 314, a gain for the offense of 1, 2, 3 . . . 10, 15 or 20 yards would be randomly selected by scoring computer 102. This gain of yards for the offense would be displayed on secondary display 108 with a graphical representation of a football 330 advancing from left to right on the graphical display of the football-type field 302 of FIG. 3B. The determination of the filled framed is contemplated to be evaluated according to the table of positive/negative football movements described in detail above. To continue the exemplary description of the game progression, $5^{th}$ filled frame 315 with respect to Bowler 1B "Ashley" 308 and Bowler 2B "Nicole" 312, where Bowler 1B "Ashley" 308 obtained a spare (7/) and Bowler 2B "Nicole" 312 obtained an open (6--3). According to the movement table listed above, this would result in a gain of 1, 2, 3 . . . 10, 15 or 20 yards for the offense randomly selected by the scoring computer. In one exemplary embodiment, the game of the proceeds in this manner through all 10 frames of bowling with various gains/losses applied to each of the home/visiting football teams. As is typical in the game of football, a team has 3 downs in which to positively advance the location of the football 330 a minimum distance of 10 yards. If the team on offense is unable to advance the football 330 to what is commonly known as the first down marker, the team on offense will generally punt the football to the opposing team as described above with reference to the general game rules. When either the home and/or visiting team scores, advances the football (either positively, negatively or neutral), a punt, field goal, a safety, fumble, interception, penalty flag or other football event takes place, it is contemplated that these events would be graphically displayed on the primary and/or secondary display 106, 108 respectively. Theses events as well as information such as the score for each team will be shown on the graphical representation of football-type field 302. It is further contemplated that football-type field 302 will display a home team score 316, a visiting team score 318, a first down 10 yard marker 320 and the current location (spotting) by marker 322 in alignment with football 330. Additionally, the team having possession of the football (on offense) will have an indicator 340 as a graphical representation of such possession. Alternatively, the team on defense may be graphically indicated by way of a football helmet (not shown in FIG. 3B) to designate the play status of that team. In one exemplary embodiment, the tip of football 330 may have a different color, pattern or illumination to clearly locate the current field position of the football 330. It is further contemplated that the graphics for each football team may coincide with the colors, mascots, logos etc. of well-known teams in the National Football League™ (NFL™).

In one exemplary embodiment the outcome of the secondary football game may be used to award that bowling team/individual various prizes/awards offered by the bowling center or offered by way of a frequent bowler program. By adding a secondary game feature to bowling, the excitement of the team/player is increased and an opportunity to obtain one or more prizes is presented to the team/player.

Another contemplated use for the secondary football game outcome is applied to tournament bowling play. Traditionally, tournament play comprises an individual, a pair of individuals, or a team of individuals that collectively bowl one or more games of bowling and their combined scores are used to win various prizes or awards associated with their bowling score. The number of bowling games played during a tournament many vary depending upon rules established by a tournament host. It is contemplated that the secondary football game outcome may be used to advance that team towards a series of playoff games and eventually to determine a champion team in a final season football/bowling game similar to the National Football League™ (NFL™) Super Bowl Game.

Another contemplated use for the secondary football score is applied to league bowling play. Traditionally, league play comprises a group of bowlers that meet at a scheduled time each week for a predetermined number of weeks. The league generally comprises multiple groups of individual bowlers, each group of bowlers make up a team. Each team consists of two or more bowlers, depending on the league format. The meeting time, duration of league play, number of bowlers on each team and games bowled during each scheduled meeting will vary according to the hosting facility and specific league format/rules. In a normal league format, two teams are matched against each other on a pair of lanes. The team with the highest accumulated bowling score on each pair of lanes, after each game, wins one or more point(s). Teams are ranked throughout the league season according to the points they accumulate each week and listed on a standing sheet.

In an exemplary embodiment of league play, where multiple bowlers bowl together to form a team and compete against other teams of bowlers each week, the secondary football game score may be used to advance and rank bowling (and associated football teams) within the league. Utilizing the secondary football team score, described herein, allows teams to accumulate football match up wins/losses and thereby assign the winning most teams a higher ranking on the standing sheet.

It is further contemplated that the method and system described herein may be used to host group bowling parties such as corporate events, holiday parties, merchandise parties or other social gatherings. The group bowling parties may be held using the computerized version, or manual version of the method described herein.

In an alternate exemplary embodiment, the scoring computer 102 may randomly asses a penalty to one or both teams during the evaluation of filled frame of bowling. It is contemplated that the random penalty assessment will increase the excitement and uncertainty of outcome for the secondary football-type game. For example, with reference to the evaluation of the $4^{th}$ frame 314 as describe above, the scoring computer 102 may have generated a "holding" penalty against the offense team and there by reduced or eliminated the yardage gain produced during that frame of play. It is further contemplated that that well-know penalties (such as holding, facemask, off sides, false starts, unnecessary roughness, etc.) may be included in the scoring process. Additionally, the scoring computer 102, may randomly generate a turn over such as a fumble or interception to increase excitement and uncertainty of game outcome.

Figure 4:
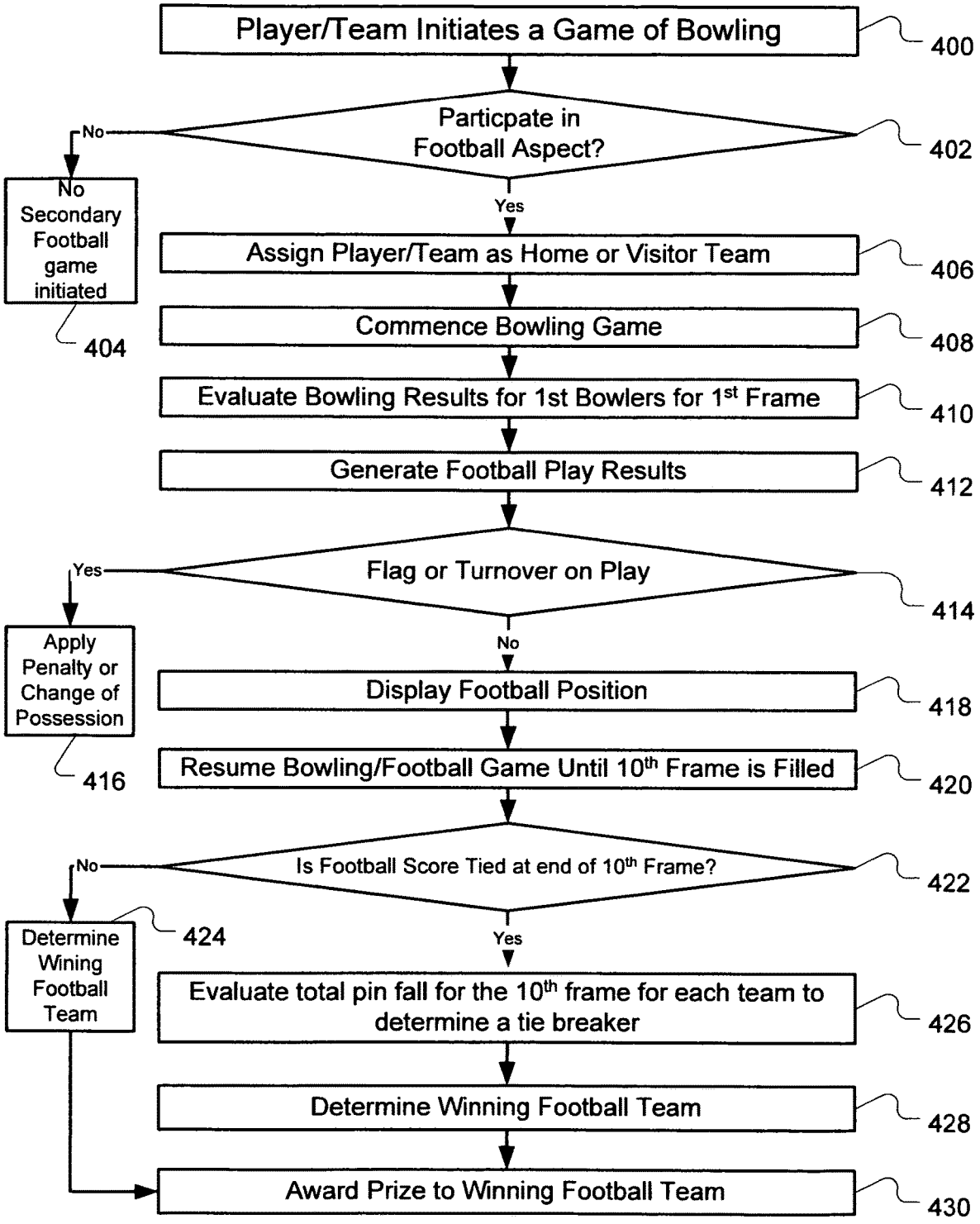
FIG. 4 is a flow diagram of a method of playing a bowling game in combination with a secondary football-type game according to an exemplary embodiment of the present invention.

Drawing attention to FIG. 4 which is an operational flow diagram illustrating potential steps for playing a bowling game in combination with a secondary football-type game. It is contemplated that most bowling participants would welcome an opportunity to increase the excitement of a bowling game and would appreciate the possibility to win an extra prize or award. Correspondingly, the following exemplary embodiment describes an implementation of the present invention that provides additional player excitement and an opportunity to obtain an additional prize/award.

At a step 400, a player or plurality of players initiates a conventional game of bowling. Typically, each player will provide their name so that their bowling scores/performance can be correctly associated with them. These names may be either manually entered into a paper scoring sheet or electronically entered into an automated scoring system. Next, at a step 402, each player will determine if they wish to participate in a secondary football-type game aspect of the bowling game in accordance with the invention disclosed herein. Should the player decide not to participate, then no secondary football game will be initiated for that player at a step 404, and the player will be not be permitted to participate in the conventional bowling game. The player/team will be assigned either as a home or visiting team at a step 406 based on which bowling lane is assigned. Alternatively, the home/visiting team assignment may be alternated on a week to week basis for traditional weekly league bowling. In one exemplary embodiment, the player/team choosing to participate in the football aspect of the game may be required to pay a fee, the funds acquired by charging this fee may then be used to provide awards as described below.

Next, at a step 408, a conventional game of bowling is commenced and proceeds according to standard bowling rules, well-known to bowlers. The bowling game will continue until the first bowlers for first frame have bowled and a bowling score for each bowler is evaluated at a step 410. According to the game rules described above with respect to movement of the football, a football play result is generated at a step 412. In one exemplary embodiment, the scoring computer 102 may randomly generate a penalty flag or turnover to enhance game excitement at a step 414. If a penalty/turnover is generated, the penalty and/or change of possession is applied at a step 416. If no penalty/turnover is generated by the scoring computer, the new football position is displayed on the secondary display 108 at a step 418.

The process of bowling and evaluating a football play continues in sequential order by each team bowler through each bowling frame until the $10^{th}$ frame is filled at a step 420. In accordance to the present invention, it is contemplated that a football play result is generated after one bowler from each team has a turn bowling. Alternatively, in the case of only one team bowling, that team will play directly against the scoring computer on a frame by frame, player by player basis.

At a step 422, the scoring computer 102 determines if the score of the football aspect of the present invention is currently tied at the end of the $10^{th}$ frame. If there is no tie, a winning football team will be determined at a step 424 and a subsequent prize may be awarded to that winning bowling team at a step 430.

Conversely, if the football teams each have the same score at the end of the $10^{th}$ frame, and a tie is determined at the step 422, the total pin fall for each team will be calculated for the completed $10^{th}$ frame. The total $10^{th}$ frame pin fall for each team will then be used to determine a tie breaker at a step 426. The team with the highest total pin fall for the $10^{th}$ frame will be determined the winner and awarded the tie breaker. Upon determining which team will receive the tie breaker (it is contemplated to be a field goal of 3 points, however, other category of scoring may be applied), a winning football team will be determined at a step 428. After determining a winning football team at a step 428, a subsequent prize may be awarded to the winning bowling team at a step 430.

It is contemplated that the awards for the winning football/bowling team may be any one of several types of open bowling prizes/awards such as: dining coupons, merchandise, free rounds of bowling play, free equipment rentals, movie tickets, concert tickets, complimentary items/services or combinations thereof.

As will now be apparent, bowling games played according to the teachings of the invention provide a number of advantages over known methods and systems which do not have a secondary football-type game combined with a conventional game of bowling as described herein.

Incorporating the use of a football-type game increases the excitement for each player by providing a second game that is played during the standard bowling game. This benefit is realized because the football plays are determined throughout the bowling match and thus excitement builds for each player until the final frame is bowled and a winning score is calculated for the football aspect of the present invention. As a result, all of the players participating in the football aspect of the bowling game, have a second competitive opportunity to "win" during the standard bowling game. By providing a football award or prize, such as a gift card, the players have chance to win additional prizes besides those that may be offered for winning the standard bowling game. Consequently, the players enjoy increased excitement and competitiveness during the bowling game.

Another benefit realized by the method and system disclosed herein is a simplified way of enhancing the excitement of bowling without adversely complicating the scoring of the underlying bowling game. By seamlessly incorporating a football-type game during standard bowling play, the underlying bowling game scoring rules remain unchanged. The football aspect provides an easily understood secondary avenue of game play. Further, football-type games are generally well-known and the rules are easily and efficiently explained to new players. As a result, the bowling game can be greatly enhanced while facilitating the standard scoring process.

While various embodiments of the invention have been described, it will be apparent to those of ordinary skill in the art that many more embodiments and implementations are possible that are within the scope of this invention. Firstly, the application of other types of sporting events may be implemented on a frame by frame, o play by play aspect such as baseball, basketball, tennis, soccer or other well-known sport. Secondly, it may be desired to have the bowling teams select a well-known football team for play throughout the bowling season such as the Giants, Raiders, Colts, Patriots etc. Finally, other types of operative implementation for the secondary football aspect may be implement such as having the football aspect separate from the bowling scoring computer such as in the form of a stand alone application for a mobile device (cell phone or tablet). In addition, the various features, elements, step combinations and embodiments described herein may be claimed or combined alone in any combination or arrangement.

What is claimed is:

1. A method of playing a physical bowling game played on at least one lane using a bowling ball and pins in which bowlers are permitted to participate in a secondary football-type game by election, the method comprising the steps of:

(a) accepting input from the at least one bowler to initiate a physical bowling game, wherein the at least one bowler forms at least one bowling team and participates in a secondary football-type game in combination with the physical bowling game;

(b) filling at least one bowling frame for the at least one bowler;

(c) calculate a bowling score for a completed bowling frame for the at least one bowler by executing machine readable code stored on a memory operatively coupled to a processor of a scoring computer and using data received from an at least one automatic pin spotter, the machine readable code configured to enable the processor to determine the bowling score for the at least one bowler;

(d) generating a football play result based on the bowling score wherein the football play result is determined by the performance of the at least one bowler on a frame-by-frame basis and selected from a pre-programed table of football play results such that a better bowling score corresponds to a better football play result by executing machine readable code stored on the memory operatively coupled to the processor of the scoring computer, the machine readable code configured to enable the processor to determine the football play result for the at least one bowler;

(e) displaying, on a frame-by-frame basis, both a football position and a football score that correspond to the football play result selected from the pre-programed table of football play results on at least one display device;

(f) continuing the bowling game and generating the football play result on a frame-by-frame basis until a $10^{th}$ frame of bowling is completed;

(g) determining a final bowling score for the at least one bowler;

(h) determining a final football game score based on the final bowling score for the at least one bowler; and (i) determining a winning football team based on the final football game score and;

(j) awarding a prize to the winning football team.

2. A method in accordance with claim 1 wherein said step (d) of generating the football play result comprises obtaining at least one of a first down, a touchdown, a field goal, a turnover or a safety wherein the first down and turnover affect the football position displayed and wherein the touchdown, the field goal and the safety affect the final football score.

3. A method in accordance with claim 1 wherein said step (d) of generating the football play result comprises advancing a football position in at least one of a positive, negative or neutral direction.

4. A method in accordance with claim 1 wherein said step (d) of generating the football play result comprises assessing a random football penalty to at least one football team.

5. A method in accordance with claim 1 wherein said step (a) of initiating the physical bowling game further comprises the at least one bowler electing to compete in a fantasy football contest based on the football play result of the secondary football-type game.

6. A method in accordance with claim 5 wherein said step (a) of initiating the physical bowling game further comprises the at least one bowler registering with a dedicated website that manages the fantasy football contest.

7. A method in accordance with claim 1 wherein said step (d) of generating the football play result further comprises crediting performance points for a fantasy football contest to the at least one bowler.

8. A method in accordance with claim 1 wherein said step (i) of determining a winning football team based on the final football game score further comprises evaluating a total pin fall for the $10^{th}$ frame and assigning a tie-breaker for the at least one bowler with the highest total pin fall for the $10^{th}$ frame.

9. A method in accordance with claim 1 wherein said step (a) of initiating the physical bowling game further comprises the at least one bowler paying an additional fee to participate in the secondary football-type game.

10. A scoring system for a physical bowling game played on at least one lane using a bowling ball and pins comprising:

at least one display device;

at least one automatic pinspotter;

at least one scoring computer operatively coupled to said at least one display device and said at least one automatic pinspotter;

said at least one scoring computer comprising:

a memory; and a processor operatively coupled to said at least one display device and said memory, said memory having a machine readable code stored therein, said machine readable code configured to enable said processor to:

(a) accept input from at least one bowler to initiate a physical bowling game, wherein the at least one bowler forms at least one bowling team and participates in a secondary football-type game in combination with the physical bowling game;

(b) calculate a bowling score for a completed bowling frame using data received from the at least one automatic pinspotter;

(c) display the bowling score on the at least one display device;

(d) generate a football play result based on the bowling score wherein the football play result is determined by the performance of the at least one bowler on a frame-by-frame basis and selected from a pre-programed table of football play results such that a better bowling score corresponds to a better football play result;

(e) display, on a frame-by-frame basis, both a football position and a football score that correspond to the football play result selected from the pre-programed table of football play results on the at least one display device;

(f) continue the bowling game and generate the football play result on a frame-by-frame basis until a 10th frame of bowling is completed;

(g) determine a final bowling score for the at least one bowler and display the final bowling score on the at least one display device;

(h) determine a final football game score based on the final bowling score for the at least one bowler;

(i) determine a winning football team based on the final football game score; and (j) award a prize to the at least one bowler associated with the winning football team.

11. A system in accordance with claim 10 wherein said machine readable code is configured to generate the football play result which further comprises at least one of a first down, a touchdown, a field goal, a turnover or a safety wherein the first down and turnover affect the football position displayed and wherein the touchdown, the field goal and the safety affect the final football score.

12. A system in accordance with claim 10 wherein said machine readable code is configured to generate the football play result which further comprises advancing the football position in at least one of a positive, negative or neutral direction.

13. A system in accordance with claim 10 wherein said machine readable code is configured to generate the football play result which further comprises assessing a random football penalty to at least one football team.

14. A system in accordance with claim 13 wherein said machine readable code is configured to assess the random football penalty further comprising at least one of holding, facemask, off sides, false starts, unnecessary roughness and applies a negative football position in accordance with the random football penalty.

15. A system in accordance with claim 10 wherein said machine readable code is configured to receive input from the at least one bowler electing to compete in a fantasy football contest based on the football play result of the secondary football-type game.

16. A system in accordance with claim 15 wherein said machine readable code is configured to generate the football play result which further comprises crediting performance points for the fantasy football contest to the at least one bowler.

17. A system in accordance with claim 15 wherein said machine readable code is configured to receive input from the at least one bowler registering with a dedicated website that manages the fantasy football contest.

18. A system in accordance with claim 10 wherein said machine readable code is configured to determine a winning football team based on the final football game score which further comprises evaluating a total pin fall for the 10th frame and assigning a tie-breaker for the at least one bowler with the highest total pin fall for the 10th fame.

19. A system in accordance with claim 10 wherein said machine readable code is configured to initiate the physical bowling game which further comprises the at least one bowler paying an additional fee to participate in the secondary football-type game.

* * * * *